United States Patent [19]

Thompson

[11] Patent Number: 5,000,678

[45] Date of Patent: Mar. 19, 1991

[54] LEAK PROOF BURNER ASSEMBLY FOR OIL LAMPS USING PLASTIC FUEL CONTAINERS

[75] Inventor: Lowell S. Thompson, Waukesha, Wis.

[73] Assignee: Lamplight Farms, Inc., Menomonee Falls, Wis.

[21] Appl. No.: 501,479

[22] Filed: May 30, 1990

[51] Int. Cl.[5] ..... F23D 3/24

[52] U.S. Cl. ..... 431/320; 362/180

[58] Field of Search ..... 431/320–325, 431/298, 301, 302, 310, 314, 315, 144, 145, 146; 362/180, 181; 126/96, 95, 45, 46, 47, 48, 260, 255

[56] References Cited

U.S. PATENT DOCUMENTS 4,025,290 5/1977 Giangiulio ..... 431/324
4,728,286 3/1988 Olsen ..... 431/320
4,805,076 2/1989 Menter ..... 431/320
4,892,711 1/1990 Tendick ..... 422/125

*Primary Examiner*—James C. Yeung
*Attorney, Agent, or Firm*—Michael, Best & Friedrich

[57] ABSTRACT

The burner assembly includes a canister molded from a synthetic thermoplastic or thermosetting material and having a neck portion defining an opening for introducing a combustible liquid into the canister and a metal cap member for covering the canister opening and holding a wick. The cap member has an annular, inner flange which extends downwardly through the canister opening and fits in sealing engagement with the inner wall of the canister neck portion and an annular, peripheral outer collar which fits over and is crimped onto a laterally outward extending annular lip on the upper rim of the canister neck portion to sandwich or capture the upper rim between the inner flange and the outer collar.

6 Claims, 1 Drawing Sheet

LEAK PROOF BURNER ASSEMBLY FOR OIL LAMPS USING PLASTIC FUEL CONTAINERS

BACKGROUND OF THE INVENTION

The invention relates to burner assemblies and, more particularly, to burner assemblies used in lamps, decorative lighting devices, and the like and having a plastic fuel container.

Burner assemblies for lamps, decorative lighting device and the like typically include a canister containing a liquid fuel and a cap for holding a wick and covering the canister. For disposable burner assemblies, the cap typically is stamped from a metal and the canister typically is molded from a plastic material and has a raised neck defining an opening through which the liquid fuel is introduced into the canister.

In one type burner assembly, the cap has a raised, central portion for holding a wick, an annular recessed portion surrounding the central portion and peripheral collar which fits over the rim of the opening in the canister. A generally vertical, annular wall interconnecting the collar and the recessed portion fits inside the canister neck. This annular wall is dimensioned so that it pushes against the inner wall of the canister neck and forms a positive seal therewith. A burner assembly employing such a mounting scheme is illustrated in FIG. 2 of U.S. Giangiulio Pat. No. 4,025,290.

Under some circumstances, such as when the canister is not properly vented, the capillary action of the wick continues after the flame has been extinguished, causing the liquid fuel to collect in the recessed area. Also, the liquid fuel can collect in the recessed area when the canister is squeezed or jostled, causing the liquid fuel to leak out through vent hole(s) in the cap.

In another type of burner assembly, the cap has a raised central portion and an intermediate portion interconnecting the peripheral collar and the central portion. The intermediate portion has a frusto-conical shape, i.e., tapers downwardly away from the raised central portion, so that there is no recessed area where the liquid fuel can collect. The peripheral collar fits over a outwardly extending lip on the rim of the canister opening and is crimped against the rim to form a seal and lock the cap in place on the canister. A burner assembly employing this mounting scheme is illustrated in FIG. 3 of U.S. Tendick Pat. No. 4,892,711.

The metal cap of such a construction can transfer heat from a burning wick to the plastic material in the region of the rim on the canister neck. The plastic material softens and the inward force exerted by the crimped collar can displace the upper portion of the neck inwardly enough to break the seal with the collar. When this occurs, the liquid fuel can leak past the collar any time the canister is tipped over or jostled.

Another type of mounting scheme is disclosed in U.S. Olsen Pat. No. 4,728,286.

SUMMARY OF THE INVENTION

A principal object of the invention is to provide a leak-proof burner assembly for lamps, decorative lighting devices and the like including a cap arranged to prevent the accumulation of fuel and provide a positive seal with the canister.

Another principal object of the invention is to provide a disposable, leak-proof burner assembly including such a cap which provides a positive seal between the cap and the canister throughout the life of the burner assembly.

Other objects, aspects and advantages of the invention will become apparent to those skilled in the art upon reviewing the following detailed description, the drawing and the appended claims.

The invention provides a burner assembly including a canister which contains a combustible liquid and has a neck portion defining an opening for introducing a combustible liquid into the canister and a cap member mounted on the canister for holding a wick and covering the opening. The neck portion of the canister terminates in an upper rim having an annular lip extending laterally outwardly from the outer wall of the neck portion. The cap member includes an upwardly extending reduced central portion having a top wall which has at least one aperture for receiving the wick, an annular, inner flange which extends downwardly through the opening and fits in sealing engagement with the inner wall of the neck portion of the canister and an annular, peripheral outer collar which fits over the lip on the upper rim of the canister neck portion to capture the upper rim of the neck portion between the outer collar and the inner flange.

The canister preferably is made from a synthetic thermoplastic or thermosetting material. When the material in the region of the upper rim portion of the canister softens from heat transferred through the cap member during burning, the inner flange prevents inward displacement and the outer collar prevents outward displacement, thereby maintaining a seal throughout the life of a disposable burner assembly. An intermediate portion of the cap member extending between the central portion and the outer collar is tapered downwardly away from the central portion to prevent collection of any liquid fuel leaking from the canister.

DESCRIPTION OF THE PREFERRED EMBODIMENTS

Figure 1:
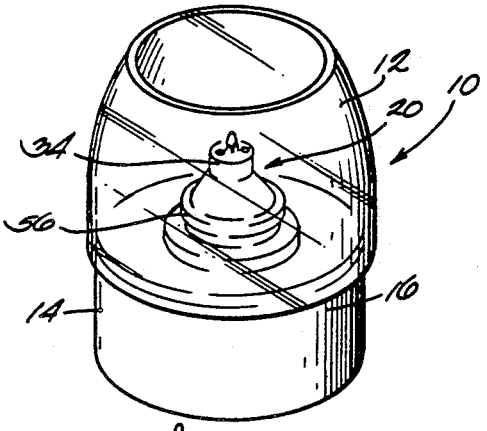
FIG. 1 is a perspective view of a decorative lamp including a burner assembly embodying the invention.

Illustrated in FIG. 1 is a decorative lamp 10 including a chimney 12 which is removably mounted on a disposable burner assembly 14 embodying the invention. The chimney 12 serves to dissipate light and can be transparent, translucent and/or colored and can have a smooth or textured surface to provide the desired aesthetic appearance and/or light transmission. The chimney 12 is held in place on the canister 16 by a frictional fit.

Figure 2:
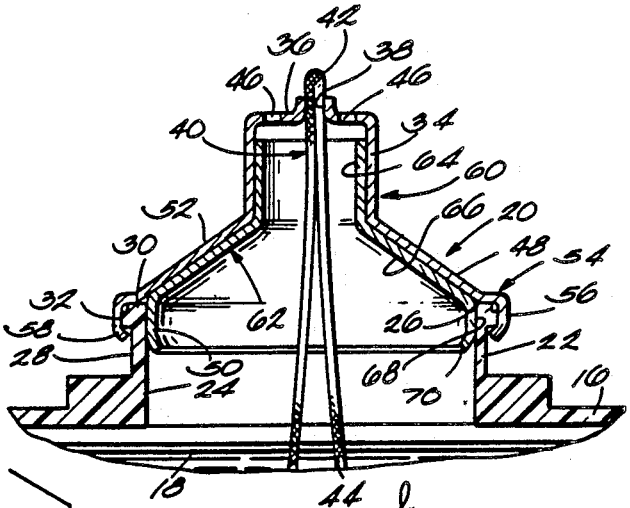
FIG. 2 is an enlarged, fragmentary sectional view of the burner assembly illustrated in FIG. 1.

The burner assembly 14 (FIG. 2) includes a canister 16 containing a combustible liquid 18, such as mineral spirits or a refined paraffin-based oil, and a cap member 20. The canister 16 preferably is molded from a suitable, inexpensive synthetic thermoplastic material, such as polyvinyl chloride, or a thermosetting material and has an upstanding neck portion 22 including an annular inner wall 24 defining a circular opening 26 through which the combustible liquid 18 is introduced into the canister 16. The neck portion 22 has an outer wall 28 and terminates in an upper rim 30 including an annular lip 32 which extends radially outwardly from the outer wall 28.

The cap member 20 preferably is made from a metal, such as tin plated steel, and includes an upwardly extending cylindrical central portion 34 having a top wall 36. The top wall 36 has a central opening 38 for receiving a wick 40 with one portion 42 extending outwardly from the top wall 36 and exposed for lighting and another portion 44 extending into the combustible liquid 18. The top wall 36 also includes a pair of small openings 46 which serve as pressure relief ports.

The cap member 20 also has an intermediate portion 48 which has a frusto-conical or hollow crown shape and a downwardly extending annular inner flange 50. The inner flange 50 extends down through the canister opening 26 and fits in sealing engagement with the inner wall 24 of the neck portion 22, when the cap member 20 is installed on the canister 16 after the canister 16 has been substantially filled with the combustible liquid 18. The outer surface 52 of the intermediate portion 48 tapers downwardly away from the central portion 34, thereby preventing combustible liquid, which might leak through the vent ports 46 or withdrawn via the wick 40 by a capillary action, from collecting on the cap member 20.

The cap member 20 also has an outer portion 54 connected to the intermediate portion 48 and including an annular, peripheral outer collar 56. The collar 56 fits snugly over and is crimped against the lip 32, preferably with the lower portion 58 bent under the lower edge of the lip 32, to sandwich or capture the upper rim 30 and the lip 32 between the inner flange 50 and the outer collar 56. A positive seal between the inner flange 50 of the cap member 20 and the inner wall 24 of the neck portion 22 is maintained throughout the life of the burner assembly 14 because the inner flange 50 prevents inward displacement of the upper part of the neck portion 22 when the material in that region softens during burning and the outer collar 52 of the cap member 20 prevents outward displacement.

Figure 3:
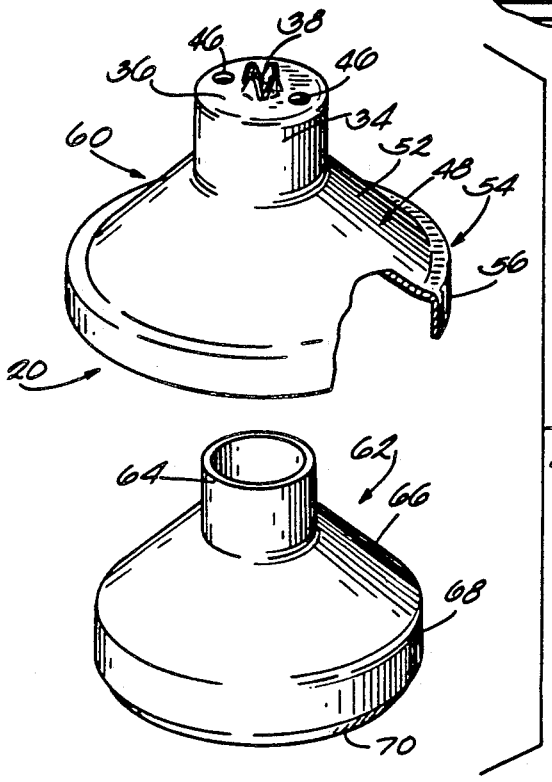
FIG. 3 is an enlarged, exploded view of the components making up the cap member of the burner assembly illustrated in FIG. 2.

While the cap member 20 can be formed as a one-piece unit, in the preferred construction illustrated (FIGS. 2 and 3), the cap member 20 includes two separate parts, an outer part 60 and an insert 62. The insert 62 has a cylindrical central portion 64, a frusto-conical intermediate portion 66 and an annular flange 68 which becomes the inner flange 50 of the cap member 20 when the two parts are assembled together. The outer dimensions of the central portion 64 and the intermediate portion 66 of the insert 62 respectively approximate the interior dimensions of the central portion 34 and the intermediate portion 48 of the outer part 60, so that the insert 62 fits snugly inside the outer part 60. The outer dimension of the insert flange 68 approximates the inside dimension of the inner wall 24 of the canister neck portion 22 to provide the sealing engagement described above. The lower edge 70 of the insert flange 68 preferably is tapered inwardly to facilitate installation of the cap assembly 20 onto the canister 16.

The insert 62 is suitably secured to the outer part 60 such as by a spot weld or the like. The insert 62 preferably is dimensioned to provide a friction or press fit with the outer part 60 in order to minimize manufacturing and costs.

From the forgoing description, one skilled in the art can easily ascertain the essential characteristics of the invention and, without departing from the spirit and scope thereof, make various changes and modifications to adapt it to various usages.

I claim:

1. A burner assembly comprising a canister containing a combustible liquid and including an upstanding neck portion having an inner wall defining an opening for introducing the combustible liquid into the canister and an outer wall terminating in an upper rim portion having an annular lip extending laterally outwardly from said outer wall; and a cap member for covering said canister opening and holding a wick, said cap member including a raised, central portion having a top wall including an aperture for receiving said wick with one portion of said wick disposed in the combustible liquid and another portion extending through said aperture and exposed for lighting.

an annular inner flange extending downwardly relative to said central portion and through said opening, said inner flange fitting into sealing engagement with said inner wall of said canister neck portion, an intermediate portion connected to said central portion and having an outer surface tapered downwardly away from said central portion, and an outer portion connected to said intermediate portion and having an annular, peripheral outer collar fitting over said lip to capture said upper rim portion of said canister neck portion between said outer collar and said inner flange.

2. A burner assembly according to claim 1 wherein said cap member is made from a crimpable metal;

said lip on said canister neck portion has a lower edge; and said outer collar on said cap member has a lower portion and is crimped against said lip with the said lower portion under said lower edge of said lip.

3. A burner assembly according to claim 2 wherein said canister is made from a synthetic thermoplastic or thermosetting material.

4. A burner assembly according to claim 1 wherein said cap member comprises a first part including said central portion, said intermediate portion and said collar; and a second part including said inner flange secured to the inside of said first part.

5. A burner assembly according to claim 4 wherein said second part includes central portion which has an outer dimension approximating the inner dimension of said central portion of said first part and fits inside said central portion of said first part.

6. A burner assembly according to claim 5 wherein said second part is secured to said first part by a friction fit between said central portion of said first part and said central portion of said second part.

* * * * *